US006671460B1

(12) United States Patent
Smal

(10) Patent No.: US 6,671,460 B1
(45) Date of Patent: Dec. 30, 2003

(54) HAND-HELD ELECTRICAL APPLIANCE SUCH AS A HAIR DRIER PROVIDED WITH POSITION ADJUSTABLE CONTROL MEMBERS

(75) Inventor: Henri C. F. J. Smal, Vise (BE)

(73) Assignee: Conair CIP, Inc., Stamford, CT (US)

( * ) Notice: Subject to any disclaimer, the term of this patent is extended or adjusted under 35 U.S.C. 154(b) by 0 days.

(21) Appl. No.: 10/069,657

(22) PCT Filed: Aug. 29, 2000

(86) PCT No.: PCT/BE00/00097

§ 371 (c)(1),
(2), (4) Date: May 29, 2002

(87) PCT Pub. No.: WO01/21030

PCT Pub. Date: Mar. 29, 2001

(30) Foreign Application Priority Data

Sep. 21, 1999 (EP) ..... 99870191

(51) Int. Cl.[7] ..... A45D 20/00

(52) U.S. Cl. ..... 392/385; 34/97; 200/5 R; 200/61.85; 200/293.1; 200/332.2; 200/18

(58) Field of Search ..... 392/383–385; 34/96, 97; 200/293, 61.85, 293.1, 332.2, 339, 1 R, 5 R, 5 A, 6 R, 6 B–6 C, 17 R, 18, 329–332.1; 219/227–241; 310/50, 66, 68 A

(56) References Cited

U.S. PATENT DOCUMENTS

| | | | | |
|---|---|---|---|---|
| 2,021,853 A | | 11/1935 | Curley | 183/49 |
| 2,157,047 A | | 5/1939 | Zwickl | 34/26 |
| 3,635,001 A | | 1/1972 | Komroff et al. | 55/274 |
| 3,846,047 A | | 11/1974 | Wada et al. | 417/234 |
| 3,849,902 A | | 11/1974 | Clark, Jr. et al. | 34/99 |
| 3,999,304 A | | 12/1976 | Doty | 34/82 |
| 4,198,556 A | | 4/1980 | Crowley et al. | 219/370 |
| 4,198,557 A | | 4/1980 | Crowley | 219/370 |
| 4,198,558 A | | 4/1980 | Benty | 219/370 |
| 4,254,324 A | | 3/1981 | Vrtaric | 219/361 |
| 4,603,246 A | | 7/1986 | Costa | 219/370 |
| 4,704,143 A | | 11/1987 | Percy | 55/274 |
| 4,711,988 A | | 12/1987 | Thaler et al. | 219/364 |
| 4,713,099 A | | 12/1987 | Schroeder | 55/385 R |
| 4,918,289 A | | 4/1990 | Ohlsen et al. | 219/370 |
| 4,972,065 A | * | 11/1990 | Ohlsen | 392/380 |
| 4,977,690 A | | 12/1990 | Davis, Jr. | 34/243 R |
| 5,216,822 A | | 6/1993 | Madiedo | 34/82 |
| 5,433,017 A | | 7/1995 | Brauchli et al. | 34/82 |
| 5,490,336 A | | 2/1996 | Smick et al. | 34/97 |
| 5,555,637 A | | 9/1996 | Montagnino | 34/97 |
| 5,632,678 A | | 5/1997 | Doelfel | 454/366 |
| 5,701,681 A | | 12/1997 | Wonka et al. | 34/97 |
| 5,715,847 A | | 2/1998 | Rolf et al. | 132/271 |
| 5,727,331 A | | 3/1998 | Thaler et al. | 34/97 |
| 5,765,575 A | * | 6/1998 | Denebeim | 132/232 |
| 5,785,064 A | | 7/1998 | Simpson | 132/226 |
| 5,810,911 A | | 9/1998 | Behrendt et al. | 95/278 |
| 5,851,112 A | * | 12/1998 | Daikuzono et al. | 433/29 |
| 5,884,008 A | | 3/1999 | Goldberg | 392/385 |
| 6,067,724 A | * | 5/2000 | Depoyian | 34/97 |
| 2002/0015593 A1 | * | 2/2002 | Kai et al. | 396/419 |

FOREIGN PATENT DOCUMENTS

DE 4105249 * 4/1992

OTHER PUBLICATIONS

Lang, D., Examiner. International Search Report Application No. PCT/BE00/00097 dated Feb. 15, 2001.

* cited by examiner

*Primary Examiner*—John A. Jeffery
(74) *Attorney, Agent, or Firm*—Ohlandt, Greeley, Ruggiero & Perle, LLP

(57) ABSTRACT

Hand-held electrical appliance of the hairdryer or similar type, including a body (1) equipped with a series of functional elements and a handle (11) displaying an array of controls (2) allowing the user to operate and adjust the said appliance, characterized in that the said handle has at least one barrel (12) which can move about its axis, and in that the said array of switches moves integrally with the barrel.

17 Claims, 3 Drawing Sheets

HAND-HELD ELECTRICAL APPLIANCE SUCH AS A HAIR DRIER PROVIDED WITH POSITION ADJUSTABLE CONTROL MEMBERS

BACKGROUND OF INVENTION

1. Field of the Invention

The present invention relates to a hand-held electrical appliance of the hairdryer, portable tool or similar device type which has controls the position of which can be varied to improve the ease and comfort of use.

In particular, it relates to a device of which the controls can be used just as easily by a right-handed person as by a left-handed person.

2. Description of the Prior Art

A great many electrical devices such as hairdryers and other appliances, be they household or other, generally consist of a body fitted with a series of functional members. These may, in the case of a hairdryer, be elements intended for heating, generally electrically, the air which is circulated by a motor and a blower and which is taken in at one end of the body. The air is heated up on contact with heating elements (generally electrical resistive elements) and then expelled at the opposite end in the form of a stream of hot air.

In general, the outlet end is shaped or may be fitted with removable adapters so as to shape the stream of hot air released.

Even if the said body is insulated, it is common practice for it to be provided with a handle which is intended for manipulating the hairdryer. Other pieces of equipment of the same type, intended for hairdressing, such as styling brushes, are shaped in a similar way.

Equally, other appliances or devices for household use are formed of a main body equipped with the functional elements and with a handle mounted on the body.

The handle is thus generally fitted with a series of controls, usually switches in the form, for example, of slides, push-buttons or rocking switches for controlling various functions.

In the case of a hairdryer to which reference will be made by way of example hereinafter, one or more switches control the speed of the blower, for which it is common, for example, to have three positions (off, low speed and high speed).

Other switches, which similarly have two and preferably three positions, control the heating. They generally have a position for switching the heating. function off, an intermediate position and a high-temperature position.

In general, an additional switch is intended to give a "blast of cold air", that is to say, for a short period of time depending on the styling operation being performed, a stream of cold air. This type of switch is generally fitted with a spring, given that it is actuated only for a very short period of time and that in normal operation it is returned to its initial position by the spring to allow the normal function preset by the two aforementioned switches to be resumed.

It is also commonplace for there to be a button for locking the set-up and starting it.

In some instances, it is commonplace to provide, for one or other function, knobs for progressive adjustment, switches of the sensitive type or push-buttons for adjusting the power. All these controls, that is to say controls for operating and for adjusting, are designed according to the type of appliance and its intended use.

These controls, operating essentially as a series or array of switches or triggers, are usually fixed to the front part of the handle or are arranged to the side.

In the case of a hairdryer, the controls are used by the operator who may be a third party (for example, a hairdresser) but may also be a person who wishes to style or dry their hair themselves.

When the array of controls is arranged to the side, it would ideally be necessary to have two different models, according to whether the user is left-handed or right-handed. When the array of controls is arranged on the front face of the hairdryer, it can be used just as easily by the left-handed as it can be by the right-handed.

However, the latter configuration is not optimal because the user holding the handle in their hand has to be able to proceed by operating the appropriate switches using the fingertips, which in theory is easier to do if these switches are arranged to the side.

This configuration is particularly preferred when somebody wishes to dry their hair themselves, that is to say when, generally when looking in a mirror, the person is pointing the hairdryer towards themselves. In this case, the array of controls, if arranged on the front face, is practically in the palm of the hand. Here again, a lateral arrangement would be preferable, but once again this runs into the problem that a left-handed operator may be unable to use a device designed for a right-handed person.

It will also be noted that some users may prefer a position that is someway between the position on the front face and the arrangement corresponding to an angle of 90° (in one direction or the other depending on whether it is a right-handed person or a left-handed person using it) corresponding to the lateral position.

SUMMARY OF THE INVENTION

The present invention sets out to provide a solution to the aforementioned difficulties, and in particular to provide an appliance for which the position of the controls can be altered according to the user's desires.

The invention will be described with reference to the appended drawings which depict one preferred embodiment of the invention relating to a hairdryer.

This embodiment is given by way of illustration for a better understanding of the invention and is not in any way restrictive as regards the scope of this invention.

BRIEF DESCRIPTION OF THE DRAWINGS

In FIG. 1, a barrel with which the handle is equipped and which bears the switches has been turned into a left-hand lateral position (switches at 90° with respect to the normal to the front face, in the anticlockwise direction when viewed from above). In FIG. 2, the handle barrel is in the front position.

Identical reference numerals are used in the various Figures for identical or similar constitutives elements.

DETAILED DESCRIPTION OF THE INVENTION

Characteristic Features of the Invention

Figure 2:
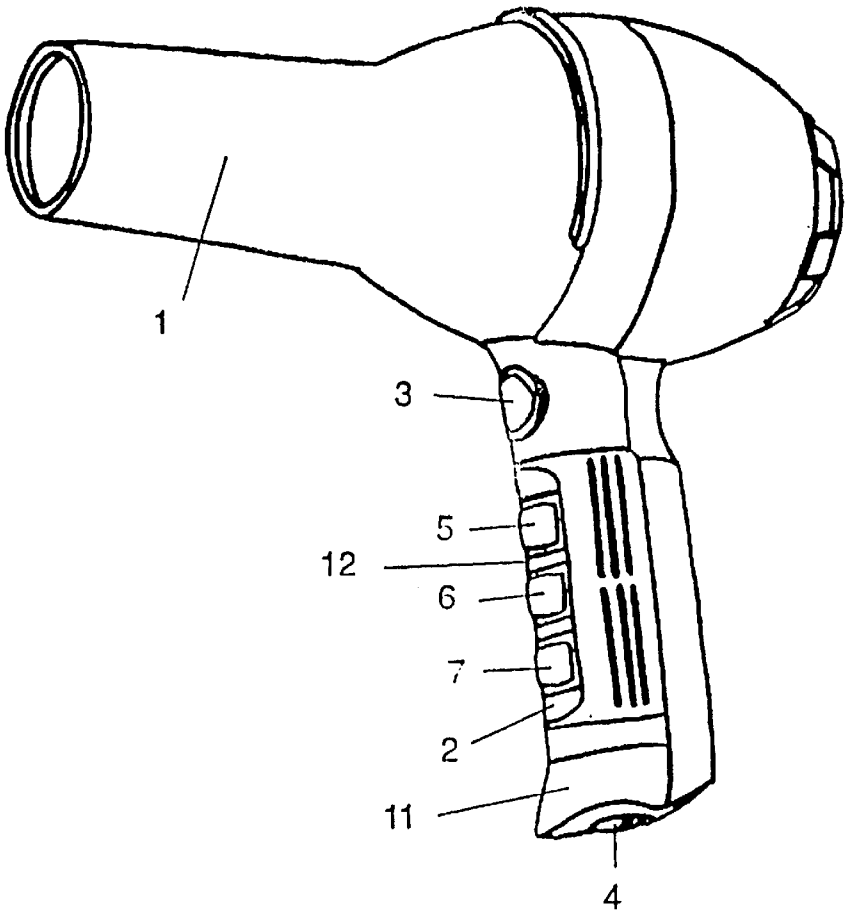
FIGS. 1 and 2 depict a diagrammatic view of a device of the hairdryer type according to the invention, comprising an array of controls, in this case switches affixed on a common barrel.

The invention relates to a hand-held electrical appliance of the hairdryer or similar type, including a body having a series of functional elements, in this instance, in the case of a hairdryer, one or more heating resistors intended to electrically heat the air, and a blower operated by a motor used to create a stream of hot air expelled from one end of the said body and by a handle exhibiting several controls such as switches allowing the user to operate and adjust the said appliance, characterized in that the said handle has at least one barrel which can move about an axis, the said controls moving integrally with the barrel on which it is affixed.

Advantageously, the barrel is equipped with at least two controls intended to perform the essential functions of the device, namely control the speed of the blower and the heating power.

As a preference, the collection of the various switches is mounted on a common barrel, but the invention does not exclude other embodiments, for example a positioning of an additional master (on/off) switch on the actual body of the handle, in a fixed position.

Several segments forming a barrel may be provided, it being possible for each segment to be equipped with one or more switches and capable of rotating independently of the adjacent segment.

The term "switch" is to be understood in its broadest sense and includes any regulator, of the stepping or continuous type, of the heating and blower-speed functions.

The switches may be of the sliding, push-button, rocking or sensitive types.

In a particularly advantageous manner, a device is provided so that the rotational movement of the barrel can be indexed by any appropriate means so that it adopts stable positions.

The said stable positions include at least a left-hand lateral position, at 90° with respect to the normal to the front face of the handle (in the anticlockwise direction when viewed from above) and a right-hand lateral position (ditto, but in the clockwise direction), passing through the anterior or front arrangement, and, as appropriate, with intermediate arrangements (for example at 45°) between, on the one hand, the left-handed lateral position and the anterior position and, on the other hand, the said anterior position and the right-hand lateral position.

It is also possible to design the barrel so that it could also adopt positions which are beyond (towards the rear) the left-hand lateral position and the right-hand lateral position, for example at 135°.

If so desired, each of the indexed positions may be locked by appropriate locking means.

As this is a hand-held electrical device, it has an electrical power supply lead which can be connected to a power outlet at one end and which enters the handle to power the appliance by passing through the switches. The wiring and/or electrical contacts inside the handle at the switches is/are designed so as not to impede the movement of the barrel when moving from one position to another and so as thereby to conform to safety standards.

DESCRIPTION OF A PREFERRED EMBODIMENT OF THE INVENTION

Figure 1:
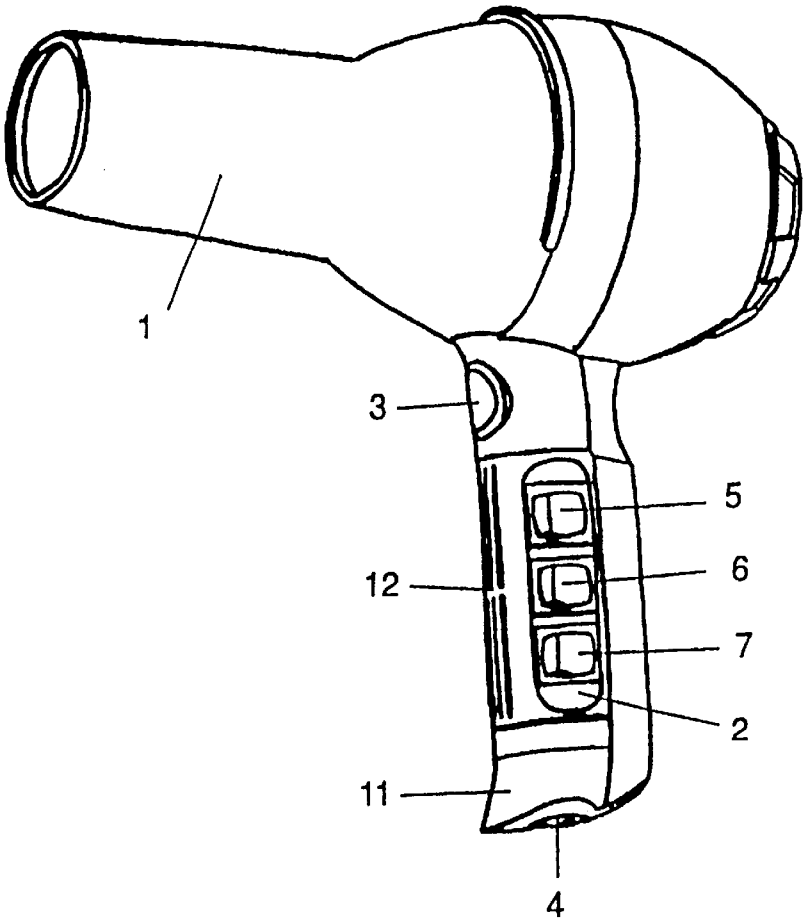

The device depicted in FIGS. 1 and 2 is a diagrammatic view of one illustrative embodiment of the invention. In this embodiment, the invention is a hairdryer. The hairdryer includes a body 1, a handle or hand grip 11, a barrel common to several controls 12, a master switch 3 and the connection 4 for the power lead (not depicted). An array of controls 2 having three switches 5, 6, 7 has been depicted. In general, a first switch 5 allows the speed of the air flow leaving the blower to be adjusted, in this instance by varying the rotational speed of this blower. A second switch 6 allows the heating of the air to be adjusted. A third switch 7 may be used, for example, as a master switch or may fulfill some other additional function.

The barrel can execute a rotational movement on an axis and can be indexed by any appropriate means in order to assume stable positions, at least starting out from a left-hand lateral position towards a right-hand lateral position, passing through an anterior arrangement and, as appropriate, with intermediate arrangements (for example at 45°) between, on the one hand, the left-hand lateral position and the anterior position and, on the other hand, the said anterior position and the right-hand lateral position.

Figure 5:
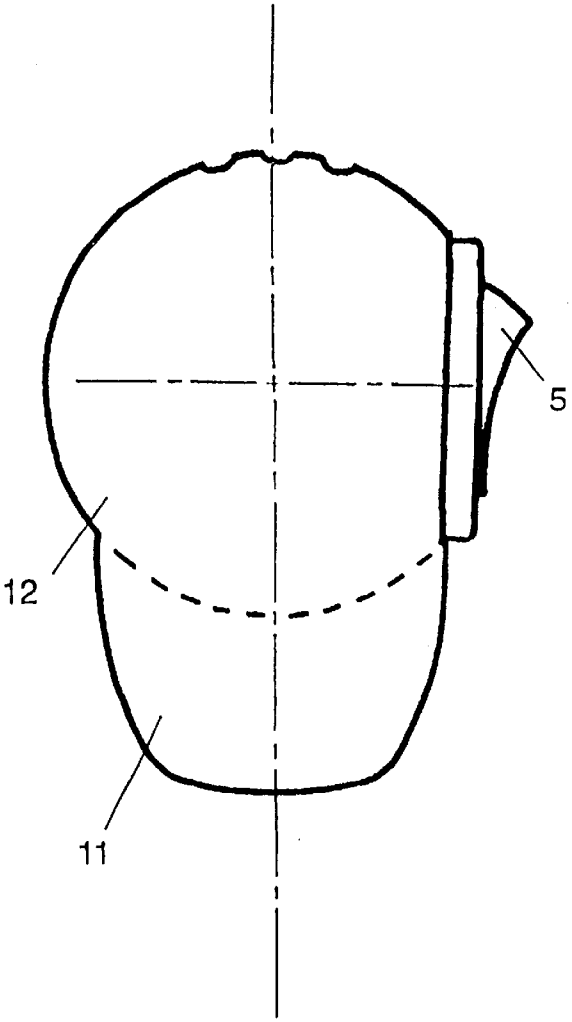
FIG. 3–5 depict end-views of the hairdryer handle according to the invention, which shows a switch, arranged in three positions of the barrel: front (FIG. 3), lateral right at 45° (FIG. 4) and lateral right at 90° (FIG. 5).
Figure 4:
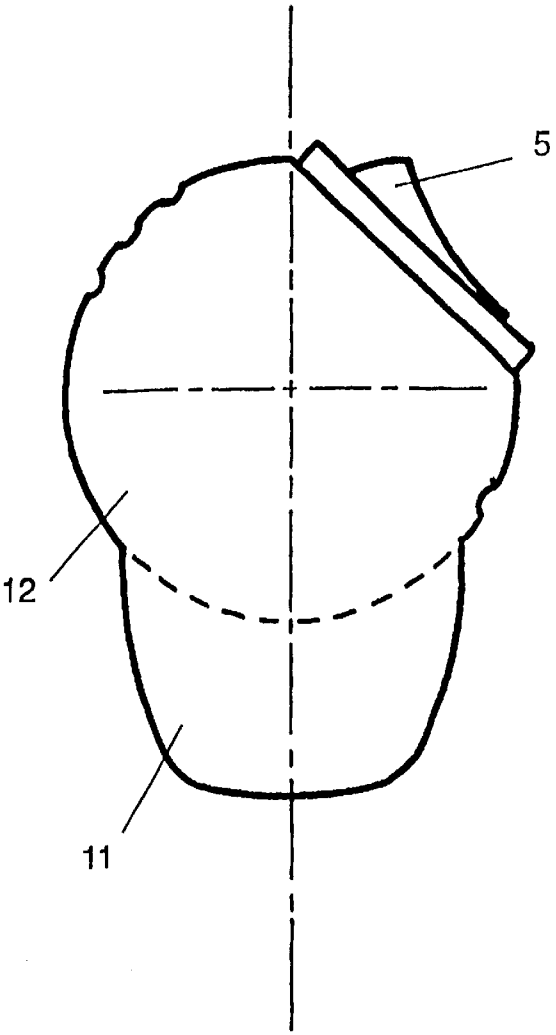
Figure 3:
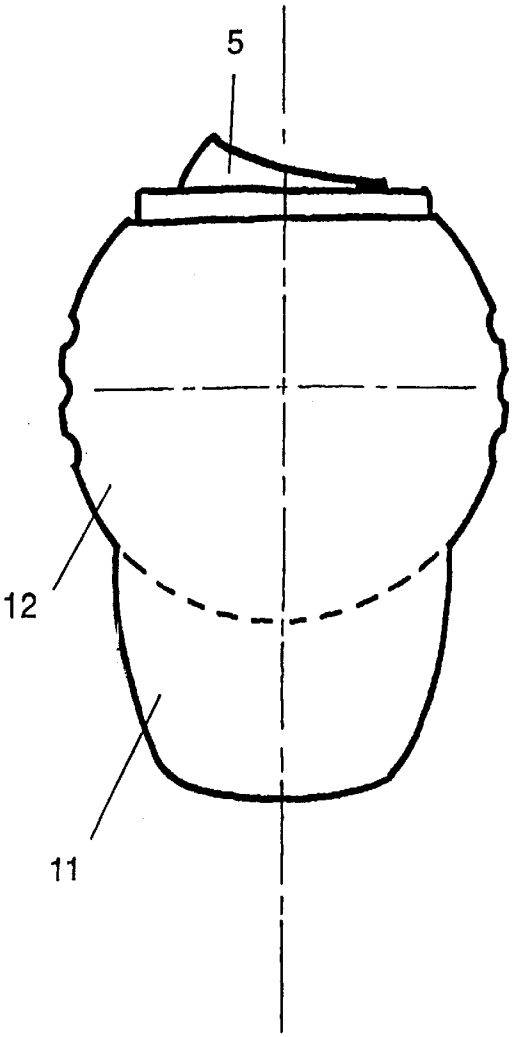

It is also possible to design the barrel so that it can also adopt positions which extend (towards the rear) beyond the left-hand lateral position and the right-hand lateral position. FIGS. 3–5 show, by way of example, three possible switch positions: front (FIG. 3), at 45° to the normal to the front face (FIG. 4) and at 90° with respect to the normal to the front face (FIG. 5).

Figure 6:
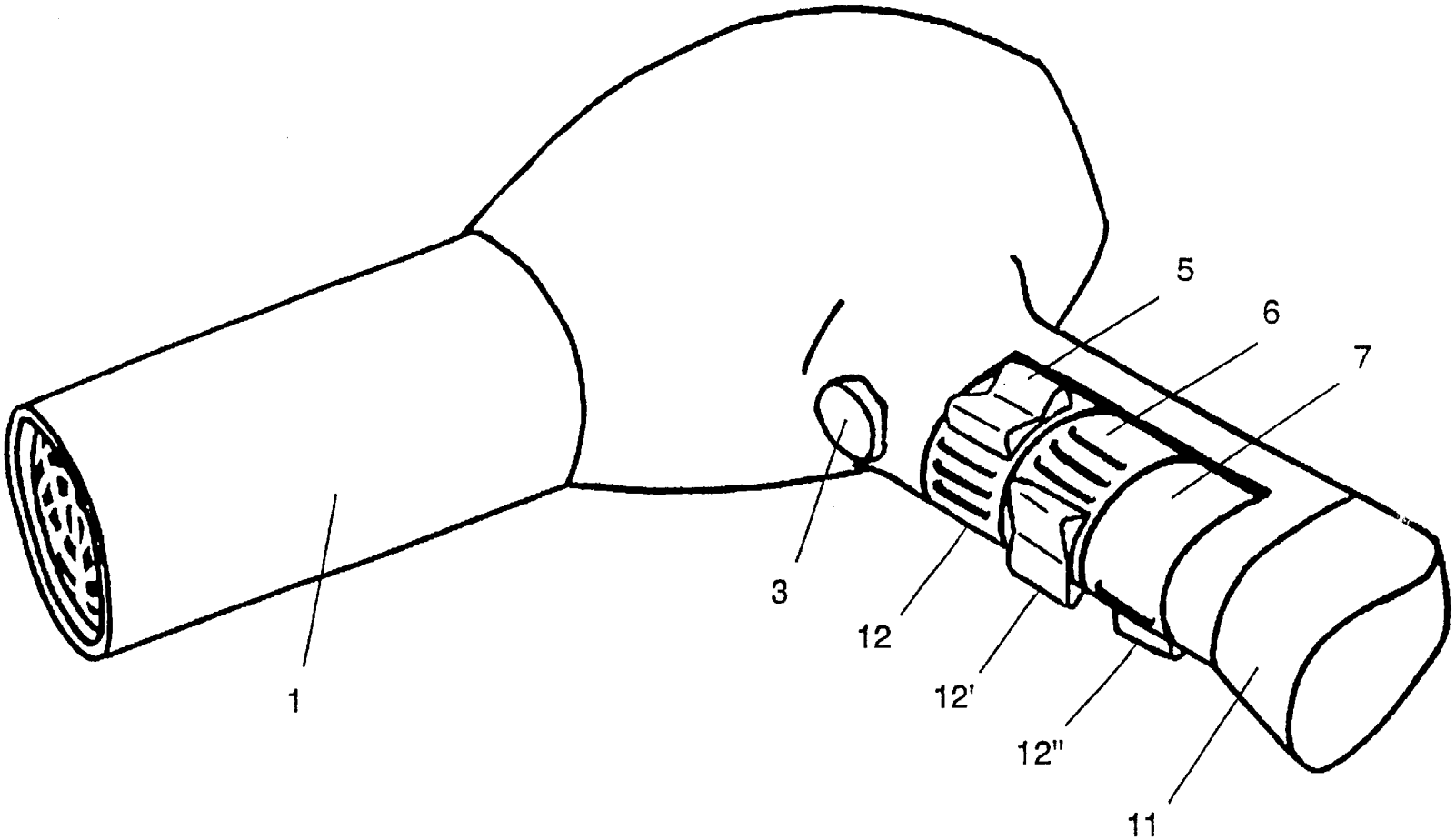
FIG. 6 depicts a view similar to FIG. 1 of a hair-dryer in a further embodiment according to the invention comprising an array of controls (switches) which are independent.

In FIG. 6, each switch 5, 6 and 7 is carried by an individual barrel 12, 12' and 12".

Each barrel may rotate on an axis which is common to the various barrels.

In the various embodiments, the axis on which the rotation of the barrel or the barrels may be a real axis or a fictive axis.

In the latter case, other material means such as guides maintaining the barrels but allowing a rotational movement may be provided.

Be it for a fictive or a real axis, it is located in the handle 11 and it is substantially parralel to the handle in the longitudinal direction.

What is claimed is:

1. A hand-held electrical appliance, comprising:

a body having a series of operating elements; and a handle with one or more controls corresponding to said series of operating elements for allowing a user to adjustably control the influence of said series of operating elements, wherein said handle has at least one barrel with several segments, each segment being fitted with at least one switch and being capable of independent rotation, and wherein said one or more controls move with said barrel.

2. The electrical appliance of claim 1, wherein said appliance is a hairdryer and said barrel has at least three switches, one of said at least three switches for adjusting the speed of a blower, a second of said at least three switches for adjusting a heating power, and a third of said at least three switches for providing a temporary stream of relatively cool air.

3. The electrical appliance of claim 1, further comprising means for indexing the rotational movement of said barrel or said several segments in a series of stable positions.

4. The electrical appliance of claim 3, wherein said series of stable positions comprises at least a front position corresponding to a front face of said handle, a right-hand lateral position and a left-hand lateral position.

5. The electrical appliance of claim 4, wherein said right-hand lateral position or said left-hand lateral position corresponds to several angular positions that can be indexed with respect to the normal to said front face of said handle.

6. The electrical appliance of claim 3, further comprising means for allowing said stable positions to be locked.

7. The electrical appliance of claim 1, wherein said at least one switch is selected from a group consisting of a slide, a push-button, a rocker or a sensitive type, and any combinations of the same.

8. The electrical appliance of claim 1, further comprising a master switch located in a fixed position on the actual body of said handle.

9. The electrical appliance of claim 1, wherein said at least one switch is provided an electrical supply by a lead connected to a lower end of said handle away from said body, and by means for allowing said barrel or said several segments to move unimpeded about its axis.

10. A hand-held electrical appliance, comprising:

a body with a number of functional elements;

a handle with an array of controls for allowing a user to operatively manipulate and adjust the electrical appliance, the handle having a barrel that can move about an axis thereof, said barrel accommodating said array of controls such that said array of controls move with said barrel; and a master switch located in a fixed position on the actual body of said handle.

11. The electrical appliance of claim 10, further comprising means for indexing rotational movement of said barrel in a series of stable positions and means for allowing said stable positions to be locked.

12. The electrical appliance of claim 10, wherein said barrel has several segments, each segment being fitted with at least one switch, each segment being capable of rotating independently of the adjacent segment, said at least one switch is selected from a group consisting of a slide, a push-button, a rocker or a sensitive type, and any combinations of the same.

13. The electrical appliance of claim 12, wherein said at least one switch is provided with an electrical supply by a lead connected to a lower end of said handle away from said body, and by means for allowing said barrel or said several segments to move unimpeded about its axis.

14. A hand-held electrical appliance such as a hair dryer, comprising:

a body with a number of functional elements;

a handle with a master control for allowing a user to actuate the electrical appliance, said handle having a barrel with several segments, each segment being fitted with at least one switch and being capable of independent rotation, wherein said barrel has a number of operative controls for allowing the user to operate and adjust the electrical appliance and which move with said barrel, and wherein said at least one switch is selected from a group consisting of a slide, a push-button, a rocker or sensitive type, and/or any combinations of the same.

15. The electrical appliance of claim 14, further comprising means for indexing the rotational movement of said barrel in a series of stable positions and means for allowing said stable positions to be locked.

16. The electrical appliance of claim 15, wherein said series of stable positions comprises at least a front position corresponding to a front face of said handle, a right-hand lateral position and a left-hand lateral position, and wherein said right-hand lateral position or said left-hand lateral position corresponds to several angular positions that can be indexed with respect to the normal to said front face of said handle.

17. The electrical appliance of claim 14, wherein said at least one switch is provided with an electrical supply through a lead connected to a lower end of said handle away from said body, and by means for allowing said barrel or said several segments to move unimpeded about its axis.

* * * * *